United States Patent [19]

Lott

[11] Patent Number: 4,571,296

[45] Date of Patent: Feb. 18, 1986

[54] TWO STAGE DESILTER

[75] Inventor: W. Gerald Lott, Houston, Tex.

[73] Assignee: Flo Trend Systems, Inc., Houston, Tex.

[21] Appl. No.: 640,962

[22] Filed: Aug. 15, 1984

[51] Int. Cl.[4] ..... B04C 5/24

[52] U.S. Cl. ..... 209/211; 210/512.1

[58] Field of Search ..... 210/512.1, 512.2, 512.3, 210/787, 388, 389; 209/211

[56] References Cited

U.S. PATENT DOCUMENTS

| | | | |
|---|---|---|---|
| 1,658,362 | 2/1928 | Walker | 210/787 |
| 2,654,479 | 10/1953 | Driessen | 210/787 |
| 2,886,287 | 5/1959 | Croley | 209/211 |
| 2,919,898 | 1/1960 | Marwil et al. | 209/211 |
| 3,237,777 | 3/1966 | Brown et al. | 210/512.2 |
| 3,289,775 | 12/1966 | Stone | 209/211 |
| 4,226,726 | 10/1980 | Rehm | 210/512.2 |

*Primary Examiner*—John Adee

*Attorney, Agent, or Firm*—Guy E. Matthews

[57] ABSTRACT

An integrated and transportable two stage drilling mud desilting apparatus in combination. Includes a first-stage mud inlet manifold, a second-stage inlet manifold, and a mud outlet manifold all mounted together as part of a separator body. Has a second-stage inlet reservoir mounted and connected to provide drilling mud into second-stage inlet manifold and a solids collection reservoir. Has a plurality of first-stage hydrocyclones mounted to receive mud from first-stage inlet reservoir, to separate first size solids from mud, and to discharge first size solids into solids collection reservoir. Has a plurality of second-stage hydrocyclones mounted to receive mud from second-stage inlet manifold, to separate smaller second size solids from mud, to discharge mud separated from smaller second size solids into mud outlet manifold for reuse, and to discharge second size solids into solids collection reservoir. May include shale-shaker, screen separator, desander, clarifyer and centrifugal separator respectively connected into combination.

5 Claims, 4 Drawing Figures

TWO STAGE DESILTER

BACKGROUND OF THE INVENTION

This invention relates to the cleaning of continuously circulating fluid that becomes contaminated with solid particulate and debris during circulation, and in particular to the separation of a significant portion of the silt size filterable solid particulate from the circulating fluid used in petroleum and gas well drilling operations.

DESCRIPTION OF THE PRIOR ART

The prior art is, as far as applicant is presently aware, disclosed in applicant's U.S. Pat. No. 4,352,739 and U.S. Pat. No. 4,428,425 issued to Young, et al.

Cross reference to related applications: Hydrocyclones, liquid-solids separation devices that utilize centrifugal force for settling, are used experimentally and routinely on drilling fluids. The earliest applications were large hydrocyclones capable of reducing sand content, particles larger than 74 microns. These hydrocyclones are commonly referred to as desanders. Smaller, more efficient hydrocyclones of approximately 4 inches or smaller diameter, commonly called desilters, have subsequently been developed and are also used in drilling operations. Although no performance standards have been set by any responsible industry agency for the different size hydrocyclones, the common terms desander and desilter are acceptable for large and small diameter hydrocyclones within the industry.

When small pieces of the formation called cuttings arrive at the surface in the drilling fluid for the very first time, they are the largest they will ever be again. These cuttings are removed from the drilling fluid by screens, hydrocyclones, centrifuges, etc. If they are not removed, they will be pumped back down hole, either to increase the thickness of the filtercake or to return to the surface again. The second time the particle comes to the surface, it will have broken into more particles of a smaller size, and therefore will have more surface area. These smaller particles will be more difficult to remove than the original particle would have been, and if they can be removed the amount of free liquid brought out of the drilling fluid with the cuttings will be greater. The removal of the free liquid results in the need for a larger drilling fluid system at the surface to maintain an efficient operation. Further, if the smaller particles are not removed on the first arrival at the surface, they can become too fine to be mechanically removed.

An additional disadvantage to the non-removal of the small particles is the high water necessary to reduce the total feed solids to prevent hydrocyclone underflow overloading or to reduce viscosity to obtain tolerable separation efficiency in weighted water-based drilling fluids. The required dilution to reduce feed solids is usually several times greater than that which would be needed to reduce viscosity sufficiently. As noted by Ormsby in the *Mud Equipment Manual, Handbook 6: Hydrocyclones,* International Association of Drilling Contractors (IADC) Mud Circulation Subcommittee, the drilling fluid feeding the barite salvage hydrocyclones must be diluted to a weight between 9.0 ppg and 11.0 ppg, depending on the design of the hydrocyclone and the weight of the drilling fluid system. If the hydrocyclones are not operated at maximum efficiency, all of the barites up to 20 microns and even larger can be lost. This loss reduces the desired drilling fluid properties which may be detrimental to the filtercake, but also is very economically disadvantageous. If the required system weight increases above 15 ppg, using API barites, the savings begin to decrease and above 17 ppg the savings begin to disappear entirely.

SUMMARY OF THE INVENTION

In view of the foregoing, the present invention provides a method of cleaning continuously circulating drilling fluid by discarding fine drill solids before they become too fine to mechanically remove.

A further object of this invention is to reduce the water dilution required in weighted water-based drilling fluids to reduce the total feed solids and viscosity.

Another object of this invention is to reduce the amount of chemical additions to weighted drilling fluids.

It is still a further object of this invention to provide a smaller drilling fluid system at the surface of a wellbore.

Other and further objects, advantages and features of the present invention will become apparent to one skilled in the art upon consideration of the entire disclosure. The present disclosure is described in relation to its use in petroleum and gas well drilling operations, but it is understood that this detailed description is not be taken as limiting the scope of the present invention.

Accordingly, a method and apparatus for the cleaning of continuously circulating drilling fluids that become contaminated with solid particulate and debris is provided wherein a significant portion of the silt size filterable solid particulate is separated from partially clean circulating fluid by a two-stage centrifugal separator having a first stage centrifugal separator capable of separating a significant portion of the upper range of the silt size filterable solid particulate with the liquid discharge from the first-stage separator interconnected with the inlet of a second-stage centrifugal separator capable of separating a significant portion of the lower range of the silt size filterable solid particulate.

DESCRIPTION OF THE PREFERRED EMBODIMENTS

Figure 1:
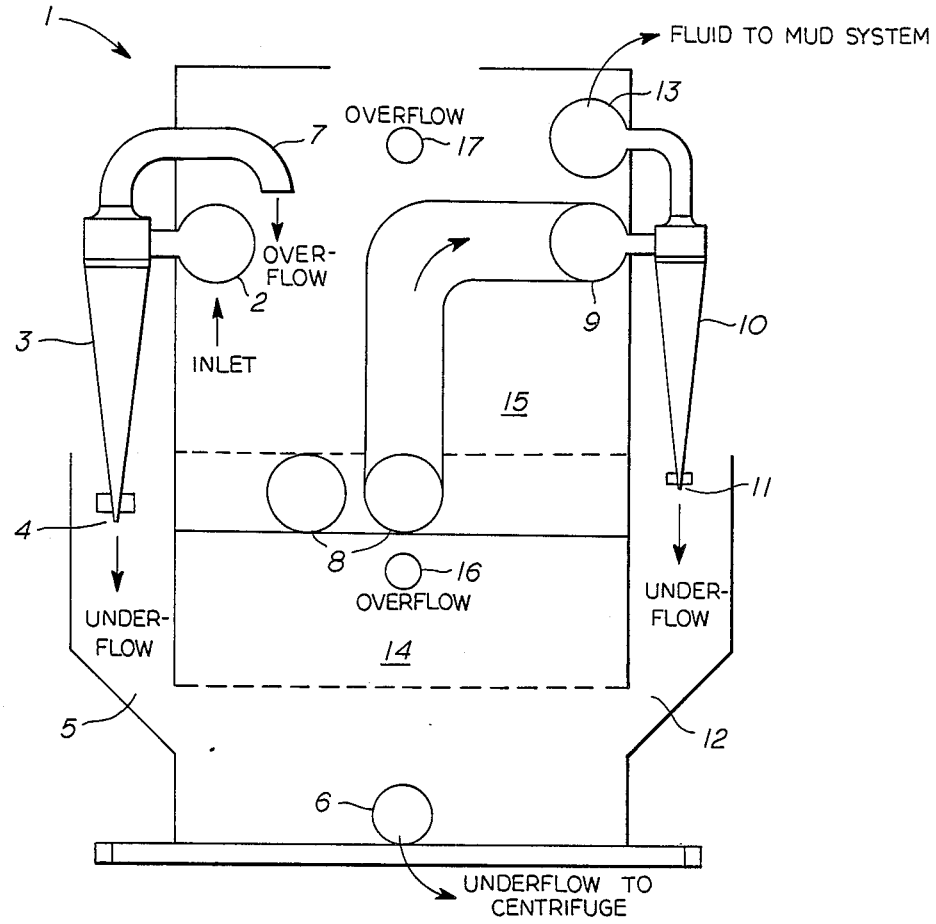
FIG. 1 is a sectional view of the two-stage centrifugal separator as disclosed in the present invention.

Referring to FIG. 1, there is shown a two-stage centrifugal separator 1 as disclosed in the present invention. Continuously circulating liquid is pumped to the separator 1 and enters the inlet manifold 2 to the first-stage hydrocyclones 3 which separates a significant portion of the upper range of silt size filterable solid particulate. The separated solids are discharged at the smaller diameter ends 4 of the first-stage hydrocyclones 3 into a trough 5. The separated solids discharged into the trough 5 are transferred through a solids collection orifice 6 located at the bottom of the two-stage centrifugal separator 1 to a centrifuge for further processing, or they can be discharged for disposal as waste.

The liquid separated in the first-stage hydrocyclone 3 is discharged through first-stage liquid discharge orifices 7 and is exteriorly pumped through connecting orifice 8 to an inlet maniford 9 to the second-stage hydrocyclone 10 which separates a significant portion of the lower range of silt size filterable solid particulate. The separator solids are discharged at the smaller diameter ends 11 of the second-stage hydrocyclons 10 into a trough 12. Similar to the separation of solids discharged from the smaller diameter ends 4 of the first-stage hydrocyclones 3, the separated solids discharged into the trough 12 are transferred to a solids collection reservoir 14 and out of an orifice 6 located at the bottom of the two-stage centrifugal separator 1 to a centrifuge for further processing or they can be discharged for disposal as waste.

The liquid separated in the second-stage hydrocyclone 10 is discharged through a second-stage liquid discharge manifold 13 and returned to the circulating liquid. The preferred embodiment of the two-stage centrifugal separator 1, as disclosed in this invention, will include emergency overflow outlets 16 and 17 for liquid and solids discharge respectively from the reservoir compartments 14 and 15.

Figure 2:
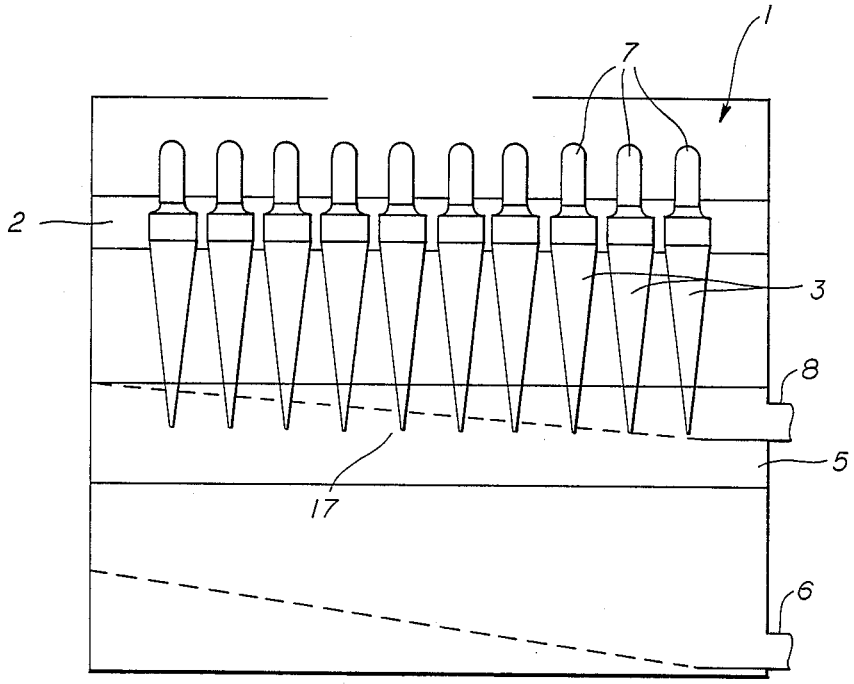
FIG. 2 is a side view of a preferred embodiment of the two-stage centrifugal separator as disclosed in the present invention.

In FIG. 2 a bank 17 of first-stage hydrocyclones 3 is shown which may vary in number and size.

Figure 3:
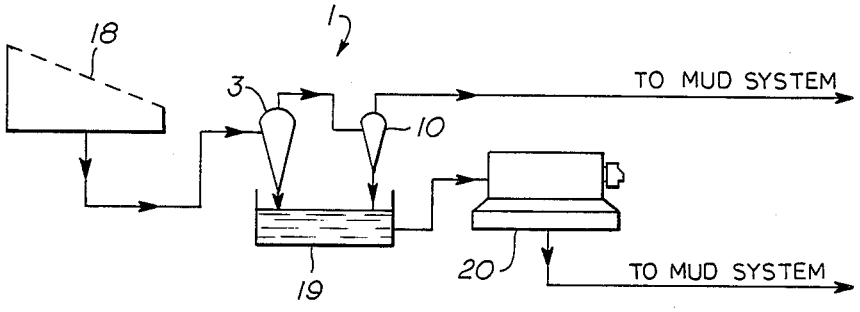
FIG. 3 is a schematic illustration of a liquid cleaning system using a two-stage centrifugal separator in accordance with the teachings of the present disclosure and a centrifuge to achieve an average 6.0 micron cut in drilling operations.

Referring now to FIG. 3, continuously circulating liquid flows through a shell shaker 18 for removal of cuttings and other large solids from the contaminated liquid. The shell shaker 18 may be a vibrating screen, rotating cylindrical, or other similar commonly mechanical device. The screened liquid is then transported to a two-stage centrifugal separator 1 for separation of liquids and solid particulate. The screened liquid from the shell shaker 18 is transported to first-stage hydrocyclone 3 and the overflow from the first-stage hydrocyclone 3 is transferred to the second-stage hydrocyclone 10 whereupon the cleaned liquid is returned to circulating liquid. The underflow from the hydrocyclones 3 and 10 flows to a collection reservoir 19 whereupon the separated solids are transported to a centrifuge 20 for further separation of liquid and solid particulate. Cleaned liquid from the centrifuge 20 is then returned to the circulating liquid.

Figure 4:
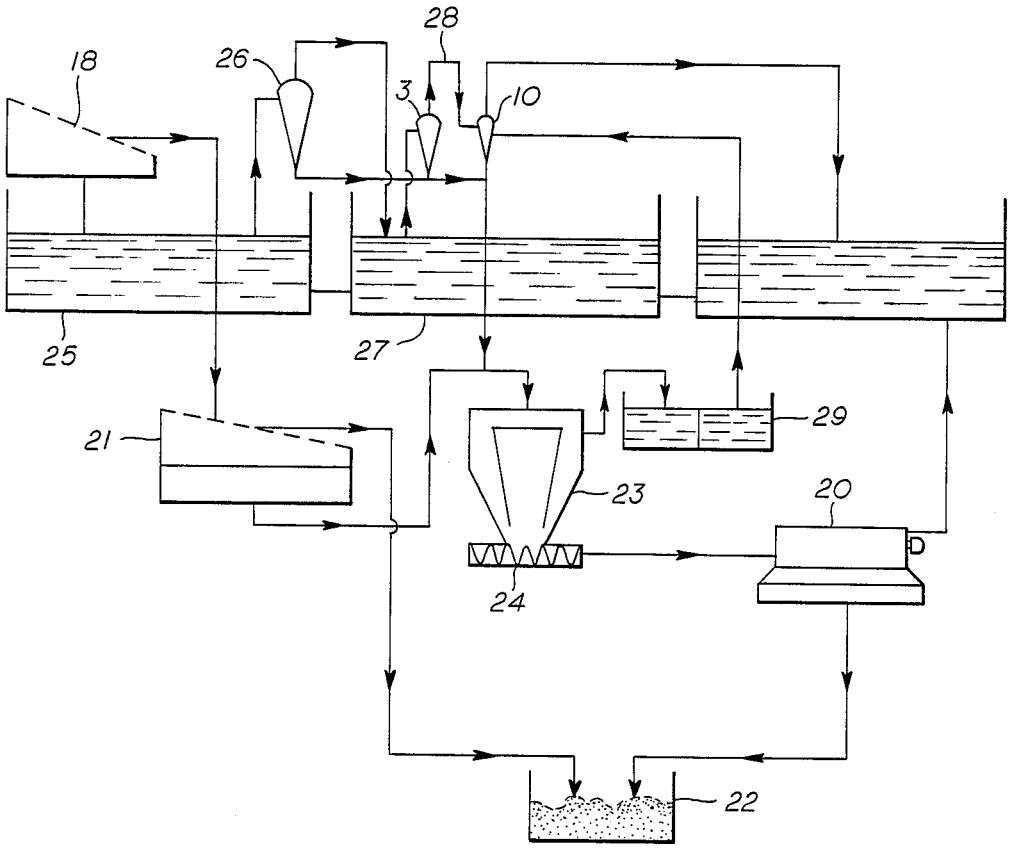
FIG. 4 is a schematic illustration of an alternative liquid cleaning system for continuously circulating fluid used in drilling operations in accordance with the teachings of the present disclosure.

A further embodiment of a method of cleaning continuously circulating liquid is described in this invention as shown in FIG. 4. Contaminated liquid is transported through a shell shaker 18 for removal of large solid particulate debris therefrom. The large solid particulate removed by the shell shaker 18 is discharged onto a screen conveyor or separator 21 for removal of liquid and solid particulate therefrom. The screened large solid particulate from the screen conveyor 21 is transported to a disposal receptacle 22 for final disposal. The screened liquid and solid particulate from the screen conveyor 21 are transported to a clarifier 23 for gravitational settling of suspended solid particulate. The liquid and suspended solid particulate from the clarifier 23 are transported by an auger pump 24 to a centrifuge for separation of cleaned liquid and solid particulate waste. The solid particulate waste from the centrifuge 20 is transported to a disposal receptacle 22 for final disposal and the cleaned liquid from the centrifuge 20 is returned to the circulating liquid.

The contaminated liquid from the shell shaker 18 is discharged to a first-settling tank 25 for separation of suspended solids by gravitational settling from liquid and filterable solid particulate. The liquid and filterable solid particulate from the first settling tank 25 is transported to a desander 26 for separation of a significant portion of sand size filterable solid particulate. The underflow from the desander 26 is transported to the clarifier 23 for gravitational settling of suspended solid particulate. The overflow from the desander 26 is discharged to a second settling tank 27 for separation of suspended solids by gravitational settling from liquid and filterable solid particulate. The liquid and solid particulate from the second settling tank 27 is transported to a two-stage desilter 28 for separation in the first stage of a significantly high portion of the upper range of the silt size filterable solid particulate to a first-stage hydrocyclone 3, and in the second stage of a significantly high proportion of the lower range of the silt size filterable solid particulate through a second-stage hydrocyclone 10. The cleaned liquid from the second-stage hydrocyclone 10 is returned to the circulating liquid. The underflows from the first-stage hydrocyclone 3 and the second-stage hydrocyclone 10 are transported to the clarifier 23 for gravitational settling of suspended solid particulate. The overflow from the clarifier 23 is transported to an emergency overflow reservoir 29 which is then transported back to the second-stage hydrocyclone 10 of the two-stage desilter 28.

The flow paths from the circulating liquids are shown by arrows in the figures. These are other alternate embodiments of this invention that are not specifically mentioned, but are meant to be included within the scope of the invention as claimed.

In operation, and referring to FIG. 1, continously circulating fluid that has been contaminated with solid particulate and debris during circulation is pumped through the separator inlet manifold 2 to the first stage hydrocyclones 3 so as to separate a significant portion of the upper range of silt size solid particulate therefrom. The separated solids are then discharged from the first stage hydrocyclones 3 into a trough 5 and then through a solids collection orifice 6 located in the bottom of the separator 1 to a centrifuge for further processing, if desired. The separated liquid is discharged through first stage liquid discharge orifices 7 located at the top of the two stage centrifugal separator 1 and is transferred through connecting orifice 8 to an inlet manifold 9 to the second stage hydrocyclone 10 which separates a significant portion of the lower range of silt size filterable solid particulate therefrom. The separated solids are then discharged at the smaller diameter end 11 of the second stage hydrocyclone 10 into a trough 12. These separated solids are transfered from trough 12 to the solids collection orifice 6 located at the bottom of the two stage centrifugal separator 1 for further processing as desired. The liquid which has been separated in the second stage hydrocyclones 10 is discharged through a second stage liquid discharge manifold 13 and then returned to the circulating liquid as cleaned liquid.

FIG. 3 details another embodiment of the present invention wherein continuously circulating liquid flows through a shell shaker 18 for removal of cuttings of the large solids from the contaminated liquid. The screened liquid is then transported to a two stage centrifugal separator 1 for separation of solid particulate and liquids. The screened liquid from the shell shaker is transported to first stage hydrocyclones 3 and the overflow from the first stage hydrocyclones 3 is transferred to the second stage hydrocyclones 10 whereupon the cleaned liquid is returned to the safe circulating liquid. In this particular adaptation the underflow from the hydrocyclones 3 and 10 flows to a collection reservoir 19 whereupon the separated solids are transported to a centrifuge 20 for further separation of liquid and solid particulate. The cleaned liquid from the centrifuge 20 is then returned to the circulating liquid.

A still further embodiment of the present invention is detailed in FIG. 4 wherein contaminated liquid is transported through a shell shaker 18 for the removal of large solid particulate debris therefrom. This large solid particulate debris is discharged onto a screen conveyor or separator 21 for removal of liquid and solid particulate therefrom. The screened large solid particulate is transported to a disposal receptacle 22 for final disposal while the screened liquid and solid particulate are transported to a clarifier 23 for gravitational settling of the suspended solid particulate. The liquid and suspended solid particulate from the clarifier 23 are then transported to an auger pump 24 to a centrifuge for separation of clean liquid and solid particulate waste. The solid particulate waste from the centrifuge 20 is transported to a disposal receptacle 22 for final disposition, and the cleaned liquid from the centrifuge is returned to the circulating liquid. Contaminated liquid from the shell shaker 18 is discharged to a first settling tank 25 for the separation of suspended solids by gravitational settling from the liquid and filterable solid particulate. The liquid and filterable solid particulate from the first settling tank 25 is then transported to a desander 26 for separation of a significant portion of the sand size solid filterable solid particulate. The underflow from the desander 26 is transported to a clarifier 23 for gravitational settling of the suspended particulate, while the overflow from the desander 26 is discharged to a second settling tank 27 for separation of suspended solids by gravitational settling from the liquid and filterable solid particulate.

From the second settling tank 27 the liquid and solid particulate is transported to a two-stage desilter 28 for separation in the first stage of a significantly high portion of the upper range of the silt size filterable solid particulate through utilization of the first stage hydrocyclones 3, and in the second stage of a significantly high proportion of the lower range of the silt size filterable solid particulate through second stage hydrocyclones 10. The cleaned liquid from the second stage hydrocyclones 10 is then returned to the circulating liquid.

Underflows from the first stage hydrocyclones 3 and the second stage hydrocyclones 10 are transported to a clarifier 23 for gravitational settling of suspended solid particualte. The overflow from the clarifier 23 is transported to an emergency overflow reservoir 29 and is then transported back to the second stage hydrocyclones 10 of the two-stage desilter.

It is thus seen that there is provided an improved method and apparatus for the cleaning of continuously circulating fluid that has become contaminated with solid particulate and debris during circulation. Also the invention has been described and illustrated with a certain degree of particularity, it is to be understood that the present disclosure is made by way of example only and that various changes and modifications in the details of the construction and the arrangement of the parts may be resorted to without departing from the spirit and scope of the invention as hereinafter claimed.

What is claimed is:

1. In drilling mud desilting apparatus the combination of an integrated and transportable separator unit, comprising:

(a) a first-stage mud inlet manifold, a second-stage inlet manifold, and a mud outlet manifold all mounted together as part of a separator body;

(b) a second-stage inlet reservoir mounted as part of said separator body and connected to provide drilling mud into said second-stage inlet manifold;

(c) a solids collection reservoir mounted as part of said separator body;

(d) a plurality of first-stage hydrocyclones mounted as part of said separator body and respectively connected and adapted to (1) receive mud from said first-stage inlet manifold, (2) separate first size solids from said mud, (3) discharge the mud separated from said first size solids into said second-stage inlet reservoir, and (4) discharge said first size solids into said solids collection reservoir; and (e) a plurality of second-stage hydrocyclones mounted as part of said separator body and respectively connected and adapted to (1) receive mud from said second-stage inlet manifold, (2) separate smaller second size solids from said mud, (3) discharge the mud separated from said smaller second size solids into said mud outlet manifold for reuse, and (4) discharge said second size solids into said solids collection reservoir.

2. The combination of claim 1 further including a separate centrifugal separator means connected and adapted to (1) receive the collected solids from said solids collection reservoir; and (2) centrifugally separate said collected solids from said mud;

(3) discharge the mud separated from said collected solids for reuse, and (4) discharge said collected solids to disposal.

3. The combination of claim 1 further including (a) a separate hydrocyclone desander means connected and adapted to (1) receive mud containing sand size solids, (2) separate sand size solids from said mud, (3) discharge mud separated from said sand size solids into said first stage inlet manifold, and (4) discharge said sand sized solids into a clarifyer means mounted separately from said body, and (b) said clarifyer means being further connected to receive the collected solids from said solids collection reservoir and adapted to discharge mud clarified of separated solids.

4. The apparatus of claim 3 further including:

(a) a separate shell shaker means connected and adapted to (1) receive drilling mud such as returned from a wellbore, (2) separate said mud from large size solids, (3) discharge the mud separated from large size solids into said desander means, and (4) discharge said large size solids into a screen separator means mounted separately from said body, and (b) said screen separator means being connected and adapted to discharge mud separated from said large sized solids into said clarifyer means and to discharge said large sized solids.

5. The combination of claim 4 further including a centrifugal separator means mounted separately from said separator body and connected and adapted to (1) receive said collected solids from said clarifyer means, (2) centrifugally separate mud from said collected solids, (3) discharge mud separated from said collected solids for reuse, and (4) discharge said collected solids to disposal.

* * * * *